US008495936B2

(12) United States Patent
Hsieh

(10) Patent No.: US 8,495,936 B2
(45) Date of Patent: Jul. 30, 2013

(54) WRENCH

(75) Inventor: Chih-Ching Hsieh, Taichung County (TW)

(73) Assignee: Chihching Hsieh, Taichung County (TW)

( * ) Notice: Subject to any disclaimer, the term of this patent is extended or adjusted under 35 U.S.C. 154(b) by 323 days.

(21) Appl. No.: 12/837,496

(22) Filed: Jul. 15, 2010

(65) Prior Publication Data

US 2011/0271801 A1 Nov. 10, 2011

(30) Foreign Application Priority Data

May 4, 2010 (TW) ..... 99114265 A

(51) Int. Cl.
*B25B 23/14* (2006.01)

(52) U.S. Cl.
USPC ..... 81/467

(58) Field of Classification Search
USPC ..... 81/467, 479
See application file for complete search history.

(56) References Cited

U.S. PATENT DOCUMENTS

| | | | | |
|---|---|---|---|---|
| 5,540,629 | A * | 7/1996 | Gotman | 475/248 |
| 7,313,990 | B1 * | 1/2008 | Shiao et al. | 81/479 |
| 2011/0132157 | A1 * | 6/2011 | Duvan et al. | 81/479 |

* cited by examiner

*Primary Examiner* — Thomas B Will
*Assistant Examiner* — Mai Nguyen
(74) *Attorney, Agent, or Firm* — CKC & Partners Co., Ltd.

(57) ABSTRACT

The disclosure relates to a wrench. The wrench includes a body, a torque sensor, a stick and an actuator. The body includes a cavity therein. The torque sensor is used to sense a torque applied by the body. The stick is located in the cavity of the body. The actuator is applied to move the stick to hit the body when the torque is greater than a predetermined value.

7 Claims, 8 Drawing Sheets

WRENCH

RELATED APPLICATIONS

This application claims priority to Taiwan Patent Application Number 99114265, filed on May, 4, 2010, which is herein incorporated by reference.

BACKGROUND

1. Technical Field

The present disclosure relates to a wrench.

2. Description of Related Art

Torque wrench is usually designed to provide a voice alarm generated from a buzzer and its periphery circuit. However, the voice alarm tends to be ignored in a noisy working environment.

Some vibration wrenches are also provided to solve the drawback described above, but the mechanisms in prior arts cause the gravities to shift greatly and thus affect the accuracies of the torque sensors.

SUMMARY

In one embodiment of the disclosure, a wrench is disclosed. The wrench includes a body, a torque sensor, a stick and an actuator. The body includes a cavity therein. The torque sensor is used to sense a torque applied by the body. The stick is located in the cavity of the body. The actuator is applied to move the stick to hit the body when the torque is greater than a predetermined value.

DETAILED DESCRIPTION

Figure 1:
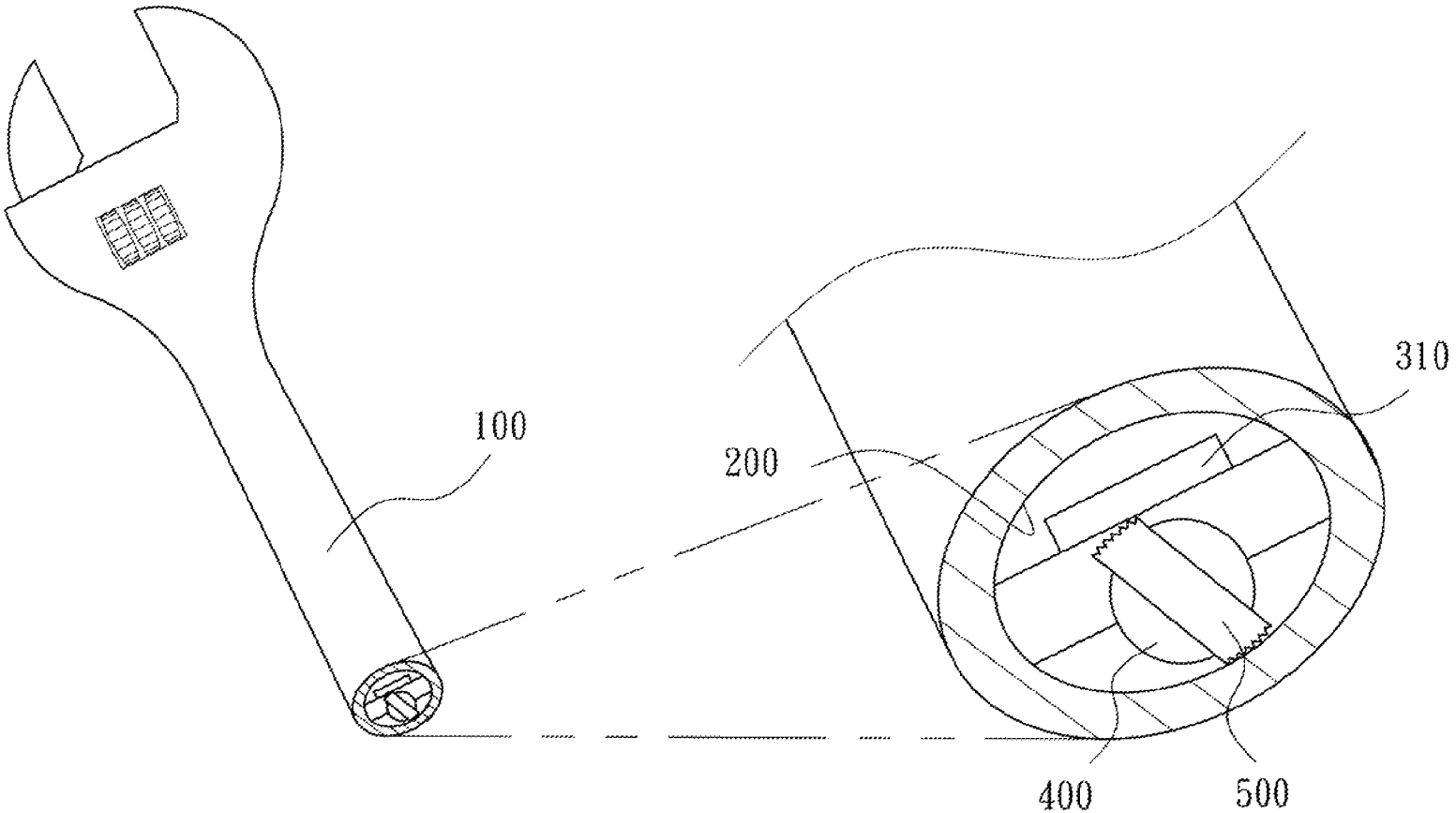
FIG. 1 is a schematic view of the wrench in one embodiment of the disclosure.
Figure 2:
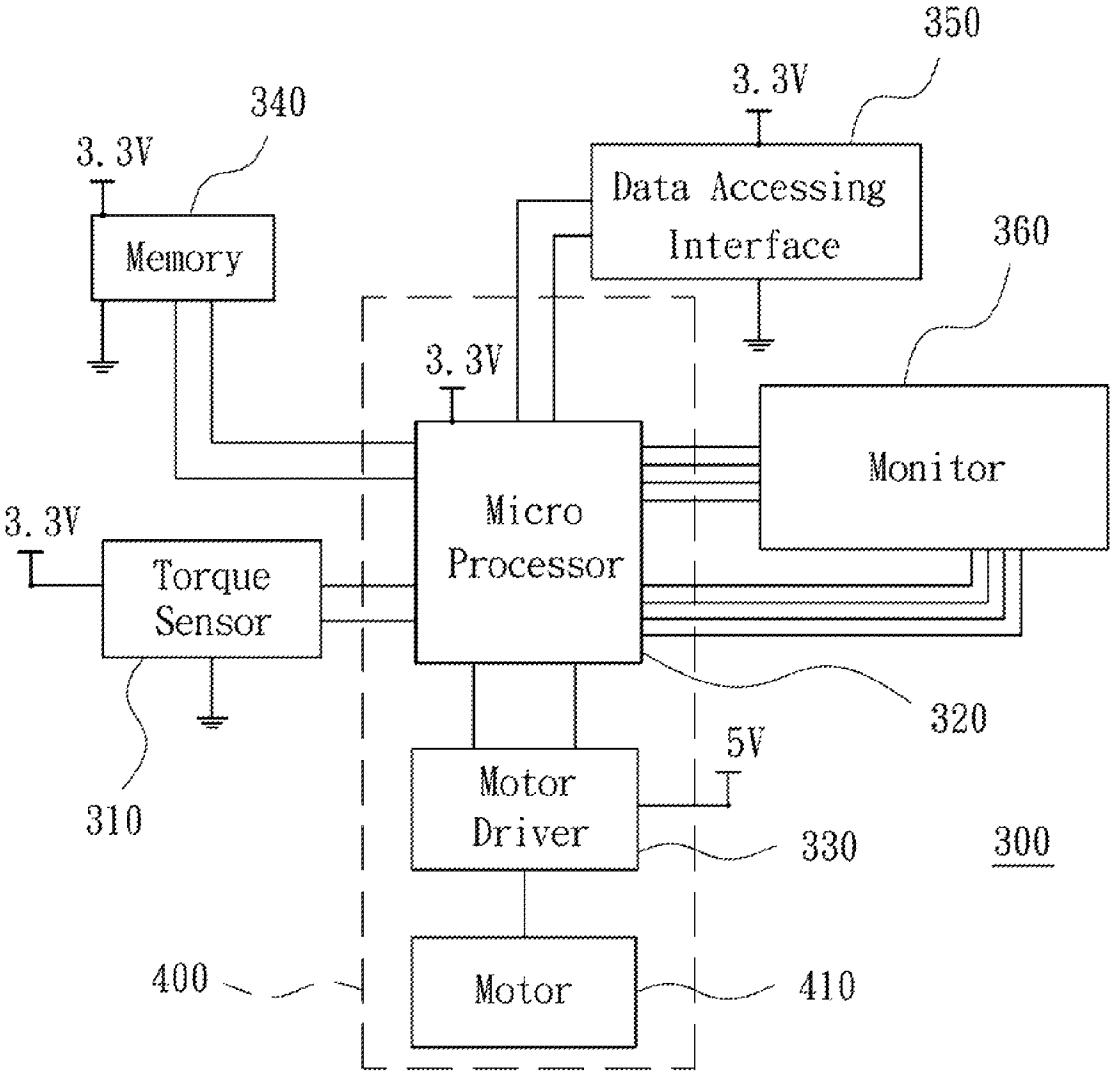
FIG. 2 is a function block view of the torque sensor of FIG. 1 and its periphery circuit.

FIG. 1 is a schematic view of the wrench in one embodiment of the disclosure, and FIG. 2 is a function block view of the torque sensor 310 of FIG. 1 and its periphery circuit. In FIG. 1, the wrench includes a body 100, a torque sensor 310, an actuator 400 and a stick 500. The body 100 includes a cavity 200 therein. The torque sensor 310 is used to sense a torque applied by the body 100. The stick 500 is located in the cavity 200 of the body 100. The actuator 400 is applied to move the stick 500 to hit the body 100 when the torque is greater than a predetermined value.

In FIG. 2, a circuit 300 is installed inside the cavity 200. The circuit 300 includes the torque sensor 310, the actuator 400 and some periphery units. The actuator 400 includes a micro processor 320, a motor driver 330, and a motor 410.

The micro processor 320 is electrically connected to the torque sensor 310, and the motor driver 330 electrically connects the micro processor 320 and the motor 410. The stick 500 is directly driven by the motor 410 to rotate itself, and thus hit the body 100 to provide a vibration alarm. Therefore, the gravity of the wrench is stabled and the vibration of the body 100 will not affect the accuracy of the torque sensor 310.

The periphery units are a memory 340, a data accessing interface 350 and a monitor 360. They are electrically connected to the micro processor 320. The memory 340 is applied to store the predetermined value, the data accessing interface 350 is applied to refresh the predetermined value, and the monitor 360 is applied to show the predetermined value and the torque value sensed by the torque sensor 310.

Figure 3A:
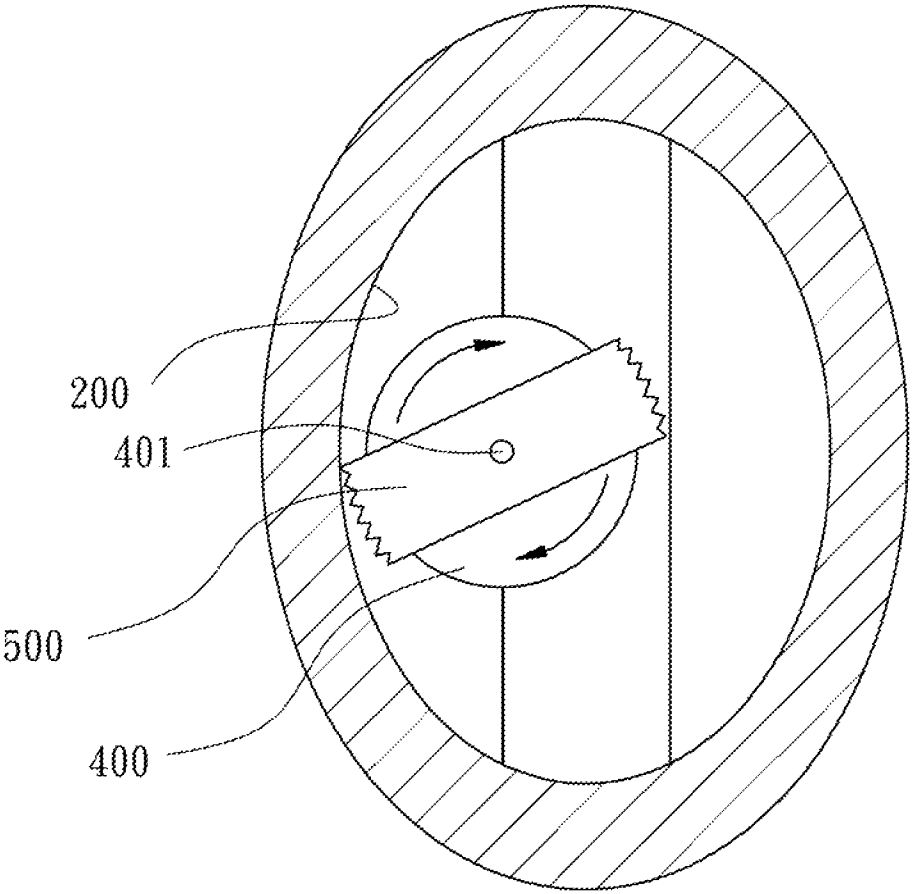
FIG. 3A is a schematic view of the vibration mechanism in one embodiment.

FIG. 3A is a schematic view of the vibration mechanism in one embodiment. The actuator 400 has a driving axis 401 which deviates from a central axis of the cavity 200. One end of the stick 500 has a serrated structure to scratch the inner wall of the cavity 200 when the stick 500 is driven by the actuator 400 via the motor 410.

Figure 3B:
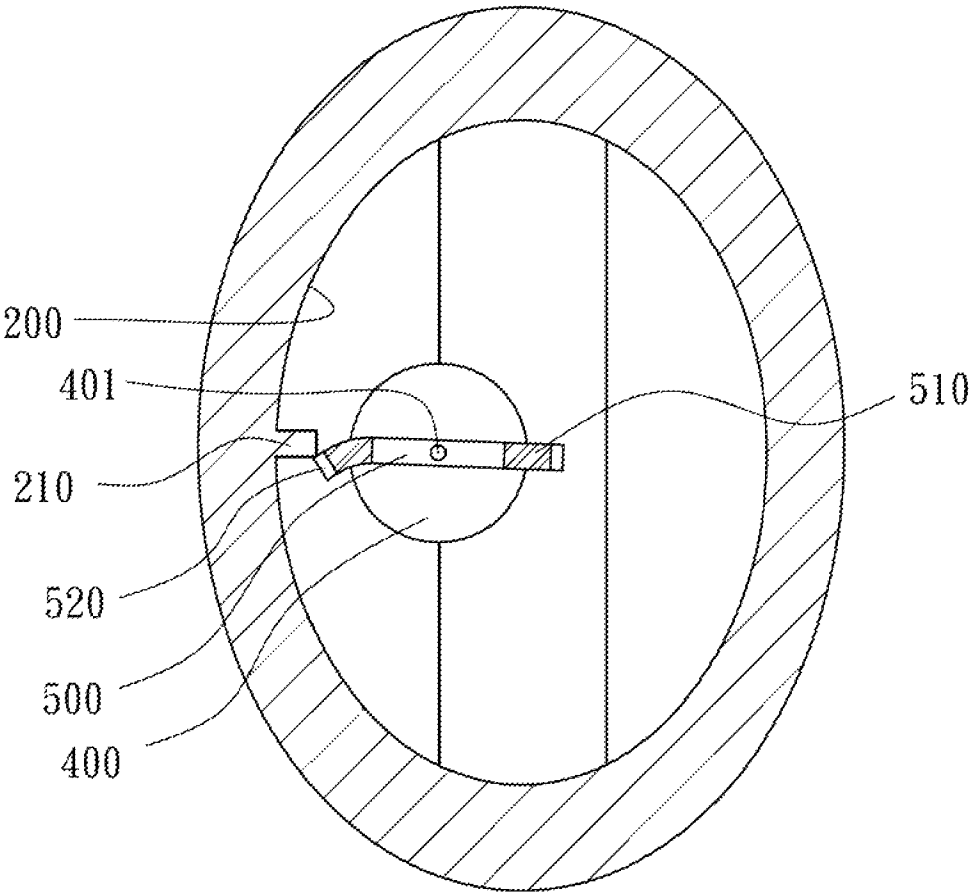
FIG. 3B is a schematic view of the vibration mechanism in another embodiment.

FIG. 3B is a schematic view of the vibration mechanism in another embodiment of FIG. 1. In FIG. 3B, the cavity 200 has a percussive bump 210, and the stick 500 further includes a flexible piece 510 and a lump 520. The lump 520 is applied to knock the percussive bump 210, and the flexible piece 510 connects the lump 520 to the stick 500. Therefore, the flexible piece 510 is flexed when the lump 520 knocks the percussive bump 210.

Figure 3C:
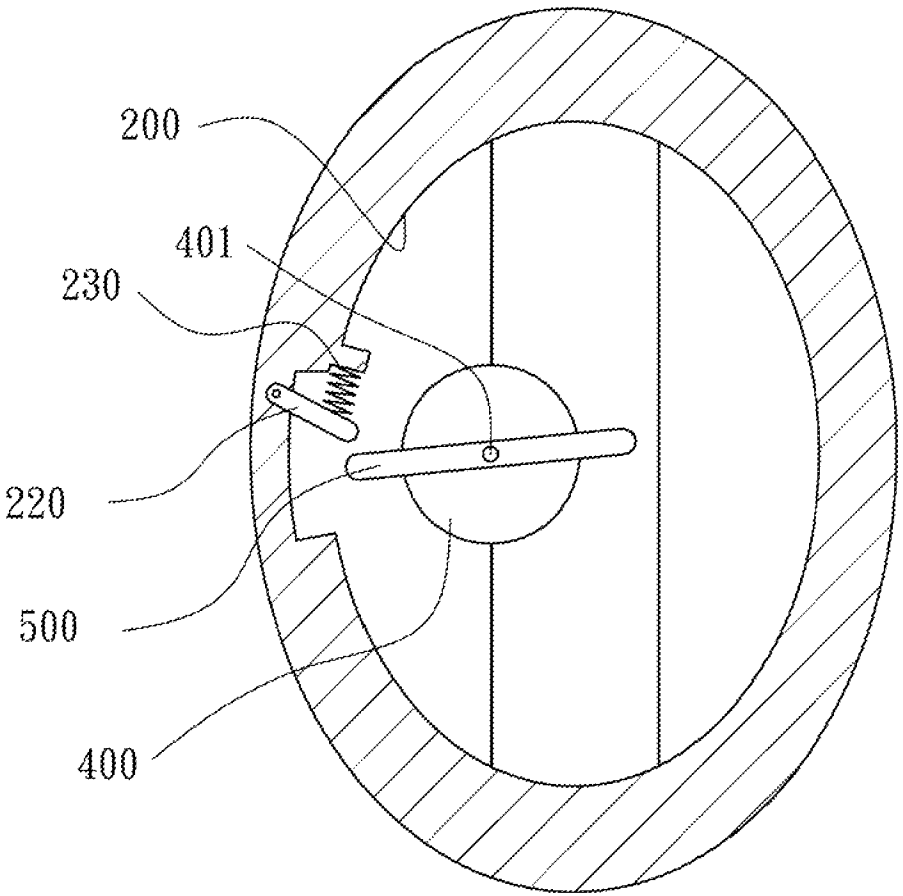
FIG. 3C is a schematic view of the vibration mechanism in the other embodiment.

FIG. 3C is a schematic view of the vibration mechanism in the other embodiment. In FIG. 3C, a percussion 220 and a spring 230 are located inside the cavity 200. One end of the percussion 220 is pivotally connected to the body 100, and the spring 230 connects the other end of the percussion 220 to the body 100. Therefore, the spring 230 is compressed when the stick 500 hits the percussion 220, and the percussion 220 is moved in pivot to let the stick 500 pass.

Figure 4:
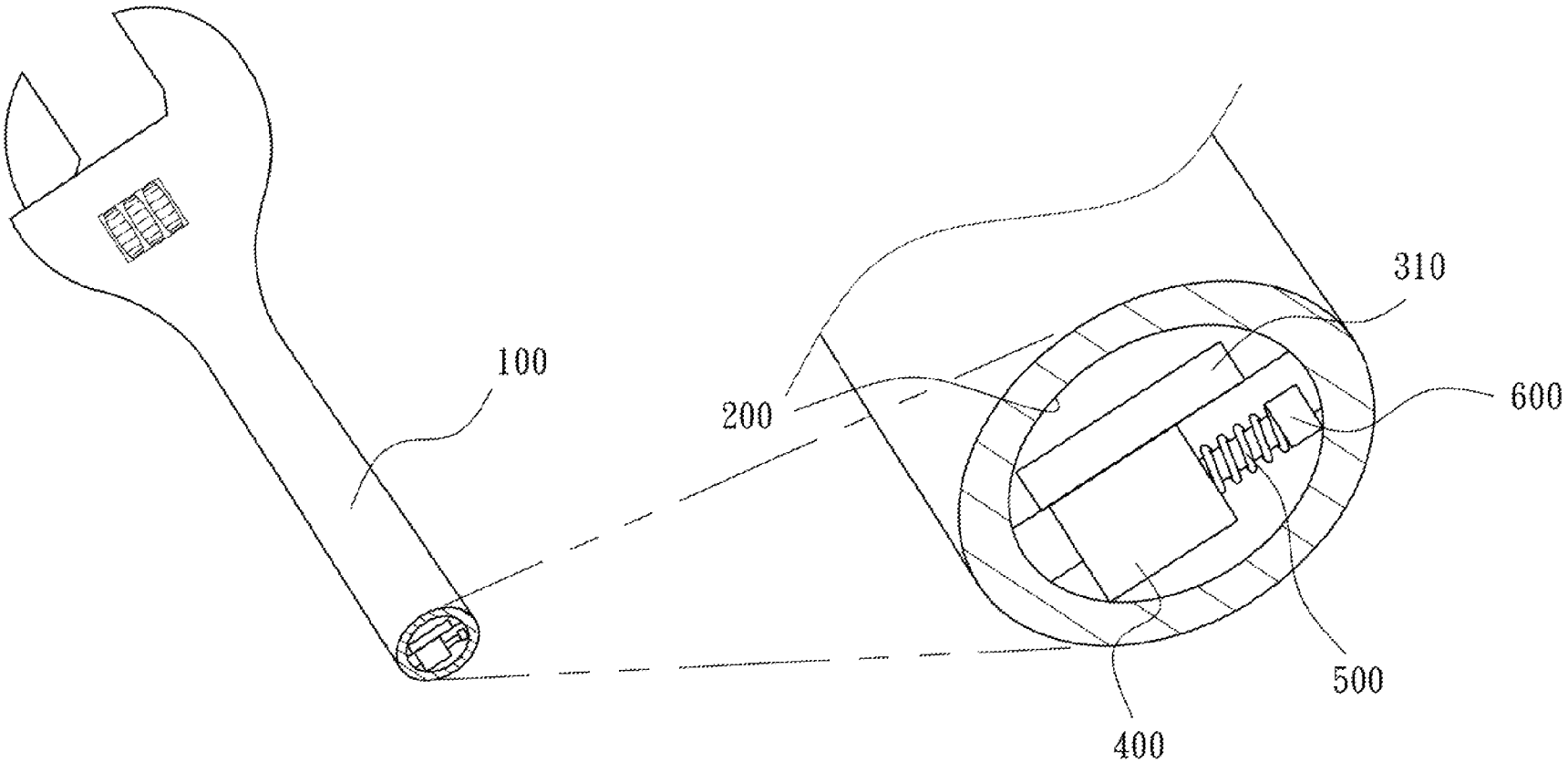
FIG. 4 is a schematic view of the wrench in another embodiment of the disclosure.
Figure 5:
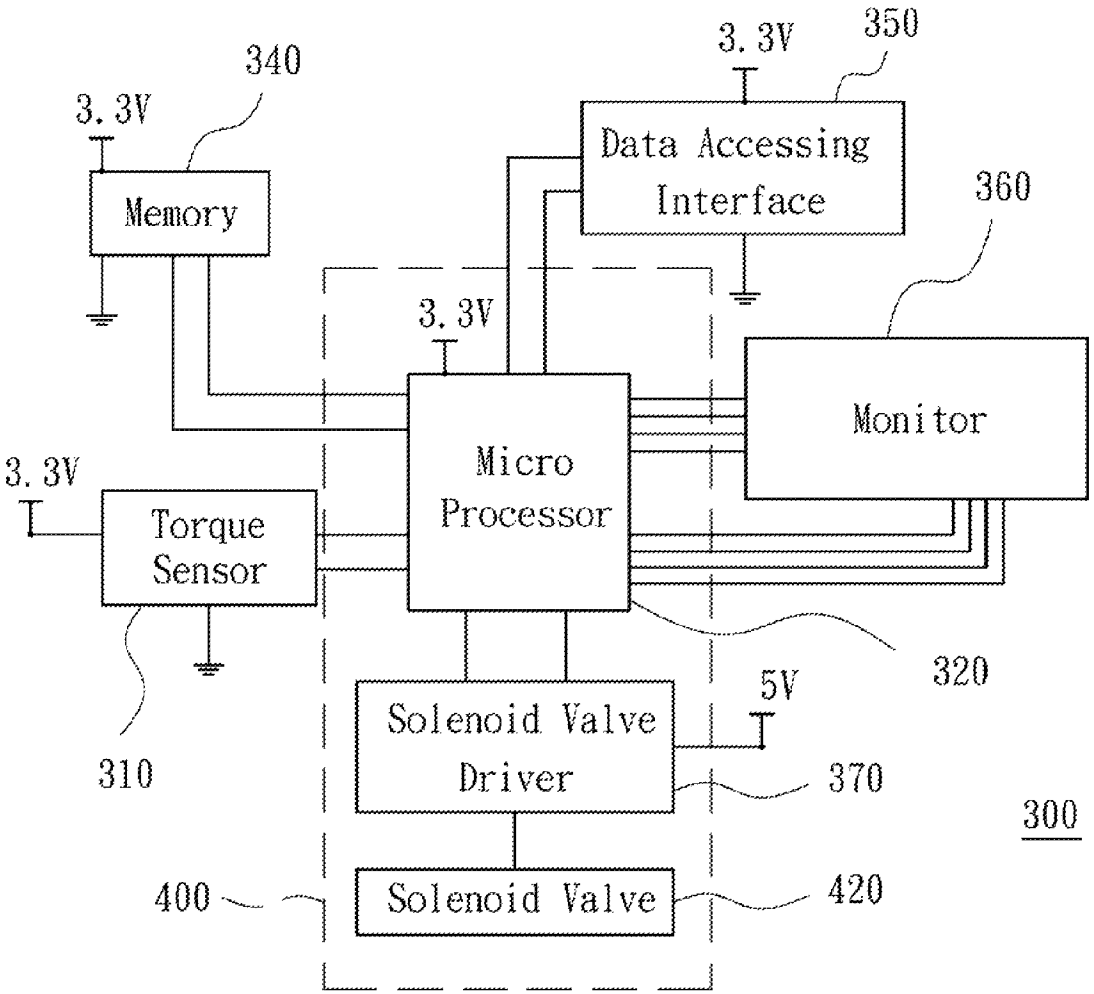
FIG. 5 is a function block view of the torque sensor 310 of FIG. 4 and its periphery circuit.
Figure 6:
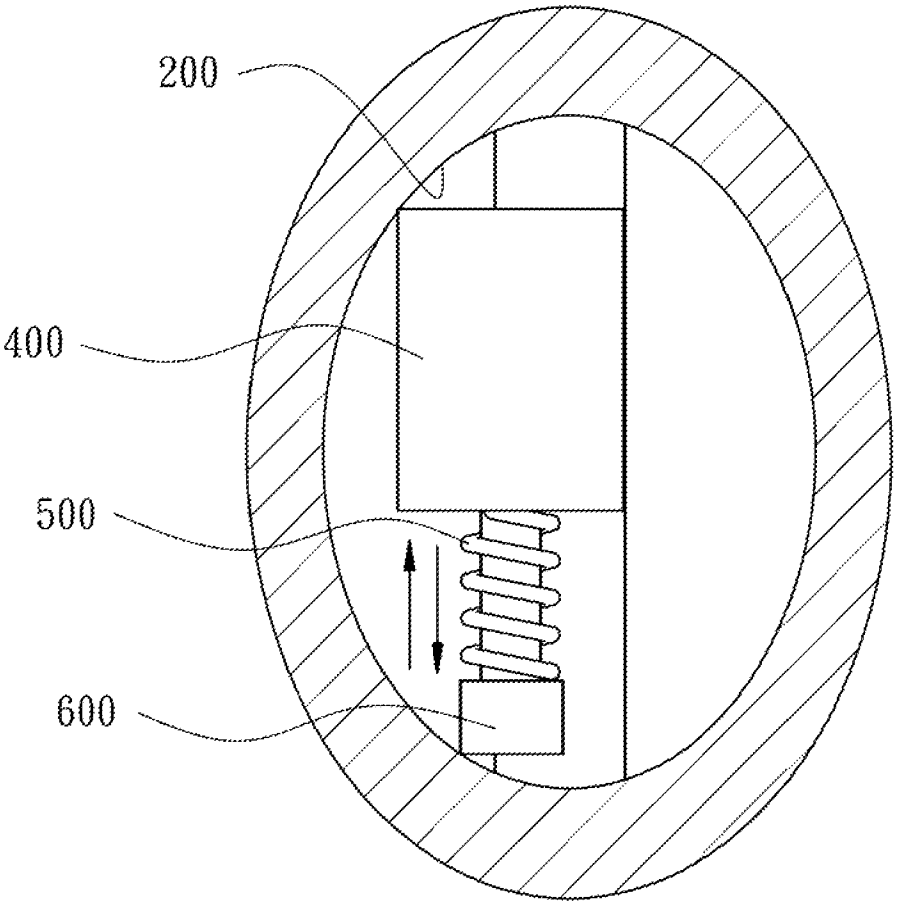
FIG. 6 is a schematic view of the vibration mechanism in one embodiment.

FIG. 4 is a schematic view of the wrench in another embodiment of the disclosure, FIG. 5 is a function block view of the torque sensor 310 of FIG. 4 and its periphery circuit, and FIG. 6 is a schematic view of the vibration mechanism in one embodiment. In FIG. 4, the actuator 400 is a solenoid valve, and a lump 600 is connected to one end of the stick 500 for knocking the body 100. In detail, the stick 500 can be applied to knock the side wall of the cavity 200 or the bottom of the cavity 200. In FIG. 5, the actuator 400 includes the micro processor 320, a solenoid valve driver 370 and a solenoid valve 420. In FIG. 6, the lump 600 is located at one end of the stick 500, and being driven by the actuator 400 to hit the cavity 200 reciprocatily.

It will be apparent to those skilled in the art that various modifications and variations can be made to the structure of the present disclosure without departing from the scope or spirit of the disclosure. In view of the foregoing, it is intended that the present disclosure cover modifications and variations of this disclosure provided they fall within the scope of the following claims.

What is claimed is:

1. A wrench comprising, a body comprising a cavity therein, wherein the cavity has a percussive bump integrally projected from an inner wall thereof;

a torque sensor for sensing a torque applied by the body;

a stick located in the cavity of the body, wherein the stick comprises a lump and a flexible piece wherein the lump is for knocking the percussive bump, and the flexible piece connects the lump to one end of the stick; and an actuator for rotating the stick to hit the body directly when the torque is greater than a predetermined value, wherein the actuator is connected to the stick directly and coaxially, and a driving axis of the actuator deviates from a central axis of the cavity.

2. The wrench of claim 1, wherein the actuator is a motor.

3. The wrench of claim 1, wherein the actuator is a solenoid valve.

4. The wrench of claim 3, further comprising:

a lump integrally connected to one end of the stick for knocking the body.

5. The wrench of claim 1, further comprising:

a memory for storing the predetermined value.

6. The wrench of claim 1, further comprising:

a data accessing interface for accessing the predetermined value.

7. The wrench of claim 1, further comprising:

a monitor for displaying the predetermined value.

* * * * *